United States Patent [19]

Giese et al.

[11] 4,366,634

[45] Jan. 4, 1983

[54] ATHLETIC SHOE

[75] Inventors: Erik O. Giese, Key Biscayne, Fla.; Roger J. Brown, Aspen, Colo.

[73] Assignee: Converse Inc., Wilmington, Mass.

[21] Appl. No.: 223,603

[22] Filed: Jan. 9, 1981

[51] Int. Cl.[3] ..... A43B 5/00

[52] U.S. Cl. ..... 36/114; 36/32 R

[58] Field of Search ..... 36/83, 114, 25 R, 32 R, 36/110, 4, 14, 51

[56] References Cited

U.S. PATENT DOCUMENTS 1,283,335 10/1918 Shillcock ..... 36/114

3,234,667 2/1966 Bovay ..... 36/114

*Primary Examiner*—Patrick D. Lawson

[57] ABSTRACT

An improved athletic shoe having an injection-molded intermediate portion bonding a fabric upper portion and a rubber outsole portion, for improved fit and comfort, and decreased injury-causing fatigue, particularly adapted for use in the playing court-type sports such as basketball is disclosed. The injection-molded intermediate portion conforms to and partially envelopes the metatarsal area and the heel area of the wearer's foot, and has an intermediate portion which gives lateral support to the instep area of a wearer's foot, such that the shoe moves as a unit together with the wearer's foot. An elastic band is provided about the ankle opening, which is disposed in the area of the subtalar ankle joint, put into tension to retain the shoe upon the foot of the wearer as the shoelace is tied. An elastic collar is attached to the shoe at the ankle opening, and has a continuously-adjustable fastener, generally serving the ankle-supporting function of adhesive tape, without the associated problems of ankle taping. The shoe further includes means for reducing the incidence of inversion sprain, by effectively stiffening the lateral side of the ankle portion of the shoe, either by an inextensible T-shaped section extending to the top of the elastic collar, or by a pattern of diverging stitching in the elastic collar, preventing its vertical extension. The shoe is further provided with a sole surface configuration in the rubber outsole portion which includes a pattern of reinforced alternately obliquely disposed raised ellipses, for improved traction on wet playing surfaces.

16 Claims, 16 Drawing Figures

RIGHT INSIDE

LEFT OUTSIDE

ATHLETIC SHOE

BACKGROUND OF THE INVENTION

This application relates to an improved structure for a shoe. In particular, this application relates to an improved structure for an athletic shoe, best adapted to be used in sports involving rapid and repeated movements such as running, starting, stopping and turning, such as found in basketball and soccer.

It is desirable that such a shoe be not only light and comfortable to wear, but also provide support for the wearer's foot, as well as ankle support and protection. A shoe that does not properly conform to the wearer's foot during the movements involved in a strenuous dynamic sport such as basketball or soccer can cause discomfort and blisters, hampering the athlete's abilities. Such discomfort and even injury may also be caused by seams and rough portions inside the shoe, and in areas where there is a likelihood of relative movement between the foot and the shoe.

As is well known, the largest cause of injury to an athlete engaged in such sports is an ankle sprain due to over-inversion of the foot. The usual result of such an inversion is a tearing of the lateral collateral ligaments, such as the anterior talofibular or fibulocalcaneal ligaments. An injury to a ligament is not only painful and disabling, but also results in a permanent weakening and a lessening of the ability to participate in strenuous sports. High-topped shoes provided some protection against such injuries, but are only occassionally used by athletes because they are heavy, hot and restrict movement. Even with high-topped shoes, an athlete's ankles are customarily taped to reduce the likelihood of injury. Taping is a time consuming process which may cause skin irritation, and can even cause an allergic dermatitis of disabling intensity.

Another problem in such sports with low-cut shoes that a player can be disabled temporarily by loss of a shoe, it being relatively common for one player to step on the heel of another in a close and strenuous sport such as basketball in the course of a game, causing the player's shoe to be removed from the heel of the foot.

Good traction between the shoe and the playing surface is most desirable. Basketball is often played on wood surfaces and sweat, being an excellent lubricant for rubber, causes slipperiness. Condensation on basketball playing surfaces is also common as many playing surfaces are placed over a refrigerated ice rink in facilities used for several sports. Therefore, it would be desirable to produce an outsole, cooperating with a shoe that stabilizes the foot, which provides good traction on such surfaces for starting, stopping, running, and turning.

Numerous attempts have been made in the prior art to provide solutions for each of the individual problems noted above, but has failed to produce a suitable and practical athletic shoe satisfactory for fast, strenuous sports.

SUMMARY OF THE INVENTION

The instant invention provides an athletic shoe with a combination of features adapted for use in strenuous sports such as basketball, together with a novel outsole construction giving a good grip between the outsole and the playing surface, even with a wet and slippery playing surface.

In simplest terms, the shoe construction includes a sole and side wall of two different materials, preferably rubber and polyurethane, and stretchable upper material to help support the ankle, and an elastic band around the ankle opening for support and to retain the shoe on the wearer's foot, which band is tightened in the process of tying the laces of the shoe. A stiffening means is provided to resist stretching on at least one side of the shoe, if not both, to resist lateral movement of the ankle joint which may result in an ankle sprain. An outsole construction has a central pattern of alternately obliquely disposed elliptically-shaped ridges, for excellent running traction upon slippery surfaces, effectively presenting a plurality of narrow ridges, with high ground pressure, which are effectively stiffer in a longitudinal direction than in a lateral direction, facilitating turning movements while running without breaking traction, and providing many areas into which water or moisture displaced from the playing surface by the ridges may be channeled.

Desirable features of shoes have been expressed in numerous ways; for example, a shoe should not injure the foot, by abrading the foot and moving with respect to the foot. The shoe and the foot should move together, and the shoe should support and stabilize the foot against movement in undesired directions. It will be apparent that conventional shoes are quite stiff in a sideways direction, and that a human foot, not being quite as stiff as a shoe, requires support to protect it from injury due to twisting.

The instant invention provides such support with an injection-molded structure similar in appearance, but greatly different in function, from conventional sole construction. The heel counter is formed on the outside of the shoe, which conforms, stabilizes and supports the wearer's foot without seams and gaps and variations in thickness on the inside of the shoe, which may abrade the wearer's foot, causing skin irritation and blisters. The toe cap has side extensions which conform to the area of the joint between the five metatarsal bones and the phalanges forming the toes, (this area being commonly referred to as the ball of the foot) to provide cushioning, stability and support for the wearer's foot.

The area corresponding to conventional foxing, rather than serving as decoration or to insure an adequate bonding area between parts of the shoe, conforms to the foot of the wearer and serves to provide lateral support of the metatarsus of the foot. The heel counter, rather than serving only to reinforce the shoe against the forces due to forward acceleration by the wearer, conforms to and supports the foot in the heel area in order to restrict lateral movement of the calcaneous or heel bone and other parts of the rear foot.

Preferably, the fabric material of the upper of the shoe is chosen to provide high flexibility, and porosity for cooling. Conventional lacing reinforcement pieces in the instep area are used. An elastic band is attached to the lacing reinforcement area along the edge of the ankle opening, so that the act of tightening the laces and tying the shoe will elastically stretch this band around the ankle of the wearer. The tension on the band will provide a heel-lock function and retain the heel of the shoe on the wearer's foot without the need for extra parts or inconvenient and time-consuming operations.

In the preferred embodiment, the ankle opening of the shoe is chosen to be just below the malleoli, commonly known as the ankle bones, which are formed by rounded protrusions of the tibia and fibula bones of the lower leg.

An elastic ankle collar support is attached to the shoe at the ankle opening, and extends above the shoe to above the level of the malleoli, thus encompassing both part of the ankle joint and part of the lower leg of the wearer. This ankle support is made from an elastic material with various directional stretch characteristics and is provided with continuously adjustable fastening means so that the tightness can be adjusted to fit the individual's desired degree of support. One such means is hook-and-loop fasteners sold under the trademark Velcro. The height of this ankle support portion may be varied to match the support needed for use of the shoe in various sports. For example, in a soccer or football shoe, the height of the ankle support portion would preferably extend just over the malleoli or ankle bones; while extending substantially above the malleoli and on to the lower leg for use with sports such as basketball and other court-type sports such as racketball.

Therefore, it is an object of the invention to produce an athletic shoe having a rubber outsole portion and a fabric upper portion, joined by a unitary injection molded resilient intermediate portion, which conforms to and supports the tarsus and metatarsus of the wearer's foot, and the area of the foot adjacent the joint between the metatarsus and phalanges. The fabric upper portion includes an elastic band around the ankle opening joined to reinforced lacing portions so that tightening of the shoelaces of the shoe will tighten the elastic band and retain the shoe on the wearer's foot. An ankle collar support portion extends above the ankle opening of the shoe, to above the malleoli or ankle bones, and includes an elastic material provided with continuously adjustable fastening means. Further, a stiffening means is provided on at least the lateral side of the shoe for resisting vertical stretching of the lateral side to resist movements causing inversion ankle sprains. It is a feature of the invention that the foot of the wearer may be stabilized, cushioned and supported by a single injection-molded shoe element. It is an advantage of the invention that the features produced by the unitary injection-molded portion do not cause discontinuities or seams on the interior of the shoe which may cause damage to the wearer's foot.

It is a further object of the invention to provide an outsole portion for a shoe which includes at least a central portion surface with a plurality of raised elliptically-shaped ridges, joined and interconnected by straight, raised ridges, and disposed in an alternately oblique fashion defining a generally W-shaped repeating pattern on the outsole surface. It is an advantage of the invention that improved traction is provided on playing surfaces including playing surfaces made slippery by moisture. It is a feature of the invention that this patternn is slightly more flexible in the lateral direction, allowing a turning motion in running without interrupting contact between the outsole and a supporting surface.

Other objectives, advantages and features of the invention will become apparent from the discussion below.

DESCRIPTION OF THE PREFERRED EMBODIMENT

Figure 1:
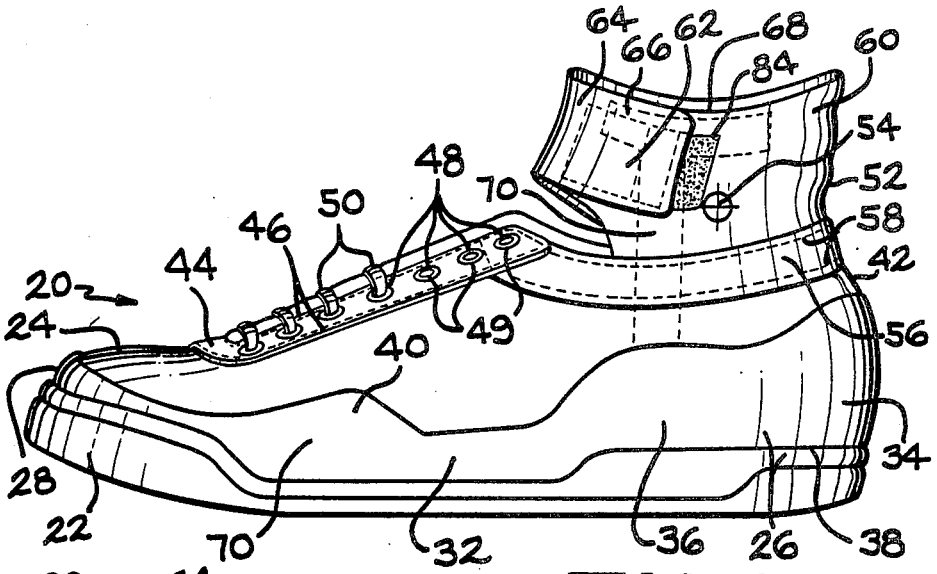
FIG. 1 is a side elevational view of the lateral side of a first embodiment of a shoe according to the invention, showing a first embodiment of means for resisting inversion sprains of the ankle of a wearer.

FIG. 1 illustrates a shoe structure adapted for use in sports such as basketball, racketball, and other court-type sports, where lateral forces are unusually large due to quick sideways movements of the players. In FIG. 1, shoe 20 is shown as including an outsole portion 22, preferable made of rubber, an upper portion 24, preferably made of an inextensible but flexible material, to maximize flexibility at ankle and heel portions, and an intermediate portion 26. Portion 26 is preferably formed by injection-molding of liquid polyurethane foam, although other materials may serve as well. The shapes, contours and thickness of the walls of intermediate portion 26 provide support around the heel for improved rear foot control, afford good lateral support to the forefoot for prevention of roll-over, and as a whole reduce fatigue and possible foot and ankle injury. Shoe 20 is preferably formed by placing a pre-formed upper portion 24 and a pre-molded outsole sole portion 22 in an injection mold and injection-molding intermediate portion 26 between portions 22 and 24, bonding portions 22, 24 and 36 together.

As will be explained in greater detail, in conjunction with discussions of FIGS. 4 through **10*a* intermediate portion 26 includes a toe cap portion 28 serving to protect the front of a wearer's foot and provide adequate height of upper portion 24 for a wearer's toes. As can be seen in FIG. 1, intermediate portion 26 extends continuously around the periphery of the shoe, and includes a metatarsal portion 30, a side wall 32 and a heel counter portion 34 including side portions 36. Line 38 on FIG. 1** shows the upper portion of a slightly thicker wall area for additional support.

As will be described in greater detail below, metatarsal portion 30 envelopes the area of the foot around the joint between the metatarsus and the phalanges of the toes, with the highest portion 40 being located against the metatarsal heads which are the ends of five metatarsal bones involved in the joint at the ball of the foot. Heel counter portion 34 and side portions 36 are configured to follow the contours of the rear foot, to conform to the bones of the rear foot, and to provide improved rear foot control, support and stability. Side wall portions 32 extend upwardly to give additional lateral support to the wearer's foot between the rear and front of the foot. Therefore, intermediate portion 26, in elastically enveloping the sides of a wearer's foot, provides lateral stability which in turn reduces fatigue and foot and ankle injuries.

Also, the novel structure of shoe 20 allows upper portion 24 to be formed without internal seams in the toe and metatarsal areas, where the extremely high lateral forces due to the movement necessary in court-type sports cause relative movement between shoe and the wearer's foot, causing abrasion and discomfort and reducing athletic performance. Upper portion 24 necessarily includes only one internal seam, a smooth flat seam adjacent heel counter portion 34, reinforced with strip 42.

Upper portion 24 includes a reinforced lacing portion 44, attached to upper portion 24 by stitches 46 or any other convenient means, and may be provided with holes 48 and a plurality of grommets 49 to facilitate the passage of shoelace 50 through reinforced lacing portion 44 and upper portion 24. As illustrated, upper portion 24 defines an ankle opening 52 below the level of the center line of the malleoli or ankle bones of the leg of a wearer.

Upper portion 24 further includes an elastic band 56 fastened by stitches 58 or any other convenient means to upper portion 24 adjacent ankle opening 52. Elastic band 56 is fastened, by stitches 58 or any other convenient means, to reinforced lacing portion 44, so that the act of inserting shoelace 50 through holes 48 and tying shoelace 50 causes elastic band 56 to be placed in tension around ankle opening 52, the flexibility of the material of upper portion 24 accomodating the stretching of elastic band 56, and forming a heel lock to retain the shoe on the wearer's foot when the heel of the shoe is accidentally stepped upon by another player in a court-type close contact sport such as basketball. Elastic band 56 also helps to provide lateral support to the ankle joint, and may be made less strong, or omitted entirely, in a shoe according to the invention which is not usually subject to such high lateral support requirements or removal forces.

Above ankle opening 52, a wide elastic collar band is fastened to upper portion 24, preferably with the stitches 58 that retain elastic band 56 in the illustrated embodiment, although any other conventional suitable fastening means may be used.

As will be apparent, elastic collar 60 provides ankle support in the same manner as taping of an ankle, but in a much more convenient and non-injurious fashion, and is provided with continuously adjustable fastening means so that its tension may be adjusted to suit the wearer's desires and needs. In the preferred embodiment, the continuously adjustable fastening means are hook-and loop fasteners such as sold under the trademark Velcro, although separate laces, snaps or the like may also be used. As illustrated, elastic band 60 extends substantially above a wearer's malleoli or ankle bones.

For clarity, the details of the load-bearing portions of the continuously adjustable fastening means have been omitted from FIG. 1, although a pad 62 of hook-type fasteners is attached to the inner surface of an end 64 of elastic band 60, the hooks of pad 62 preferably directly engaging the material of elastic band 56, although a small pad of appropriate coarse material may also be disposed upon the surface of elastic band 60 to accept the hooks of pad 62.

Also shown in FIG. 1 is a first embodiment of means for resisting inversion sprains of the wearer's ankle. A T-shaped reinforcing member composed of a first strip 66 fastened parallel to edge 68 of elastic band 60, and a second strip 70 approximately perpendicularly bisecting first strip 66, and extending down into the intermediate portion 26 of shoe 20, where it may be firmly anchored in the course of forming the intermediate portion 26 by stitching or injection molding. As will be apparent strips 66 and 70 may also be formed in a unitary assembly. As will be apparent, the purpose of first strip 66 and second strip 70 is to prevent vertical stretching of elastic band 60, or of upper portion 24, thereby resisting movement of a wearer's foot in a direction and in an amount which may cause a severe inversion sprain or torn ligaments.

Figure 2:
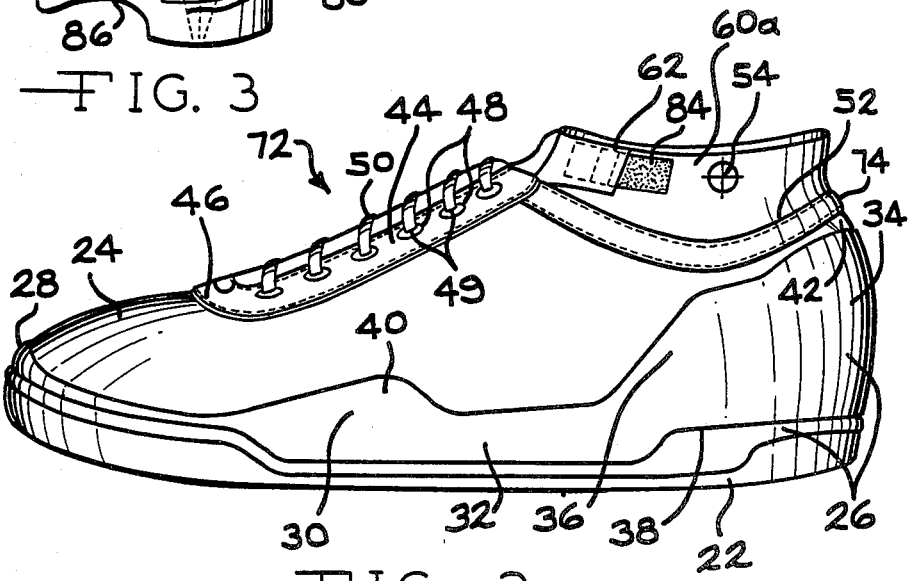
FIG. 2 is a side elevational view of the lateral side of a shoe according to a second preferred embodiment of the invention.

FIG. 2 illustrates a shoe 72 in accordance with the invention similar in most respects to shoe 20 as shown in FIG. 1, and having an outsole portion 22, an upper portion 24, an intermediate portion 26, a toe cap portion 28, a metatarsal portion 30, a side wall portion 32 and a heel counter portion 34 with side portions 36. Again, upper portion 24 forms a seamless interior, the only seam being the smooth flat seam adjacent to the heel counter portion 34 which may be reinforced by strip 42. Reinforced lacing portion 44 is retained by stitches 46 and provided with holes 49 which may be provided with grommets 48 for passage of a shoe lace 50. Upper portion 24 again defines an ankle opening 52 below center line 54 in the approximate area of the subtalar joint, and is provided with a narrower elastic band 74 fastened by stitches 76, which also fastens band 74 to reinforced lacing portion 44, so that tightening of shoelace 50 tightens elastic band 74 around the ankle opening. Since the shoe illustrated in FIG. 2 is intended for use in sports such as soccer, which may not generate the forces generated in basketball, elastic band 74 may be made narrower than elastic band 56 shown in FIG. 1. Also, an elastic collar band **60*a*, corresponding to elastic collar 60 shown in FIG. 1, which fastens to upper portion 24 adjacent to ankle opening 52, may be made narrower, extending only slightly past center line 54 to cover the malleoli or ankle bone of a wearer's ankle. Elastic collar band 60*a* is also provided with a continuously-adjustable fastening means, and serves the same function as the more complicated and occassionally injurious process of taping. As will be apparent, means for resisting inversion of the wearer's ankle may also be incorporated in the shoe shown in FIG. 2 in the same manner as shown in FIGS. 1 and 3**.

Figure 3:
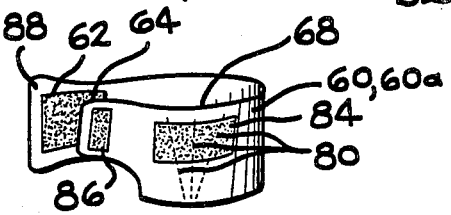
FIG. 3 is a perspective view of a preferred ankle support portion of a shoe according to the invention, illustrating a second preferred embodiment of means for resisting inversion sprains of an ankle of a wearer.

FIG. 3, in addition to illustrating a preferred embodiment of continuous-adjustable fastening means, also illustrates a second preferred embodiment of a means for resisting inversion movements. Diverging rows of stitching 80, diverging toward edge 68 from the portion of left elastic collar 60 or **60*a* in a direction and in the amount which may produce an inversion sprain. As will be apparent, additional rows of stitches 80 may be provided as appropriate to limit the extension of elastic band 60 and 60*a* in a vertical direction. As will be apparent from a consideration of the forces involved, diverging rows of stitching 80, in conjunction with the selection of a material for upper portion 24 which is flexible, but very resistant to stretching, may be used advantageously to produce these same resisting forces as produced by strips 66 and 70 as shown in FIG. 1**.

In a preferred embodiment of the invention, continuously-adjustable fastening means are provided by hook-and-loop fasteners 62, 84 and 86. In one embodiment of the shoe, fastener 86 is a hook-type fastener on the outer surface of elastic band 60, and fastener 84 is a loop-type fastener substantially longer than fastener 86 disposed on the inner surface of band 60, **60*a*. As will be apparent, end 64 of band 60, 60*a* carrying fastener 86, would be placed adjacent a wearer's ankle, and end 88 pulled as appropriate to tighten band 60, 60***a*, and then appropriately moved to engage fastener 86 with the material of band 60, 601. Subsequently, end 88 is moved to engage its loops 84 with hooks 62.

Figure 4:
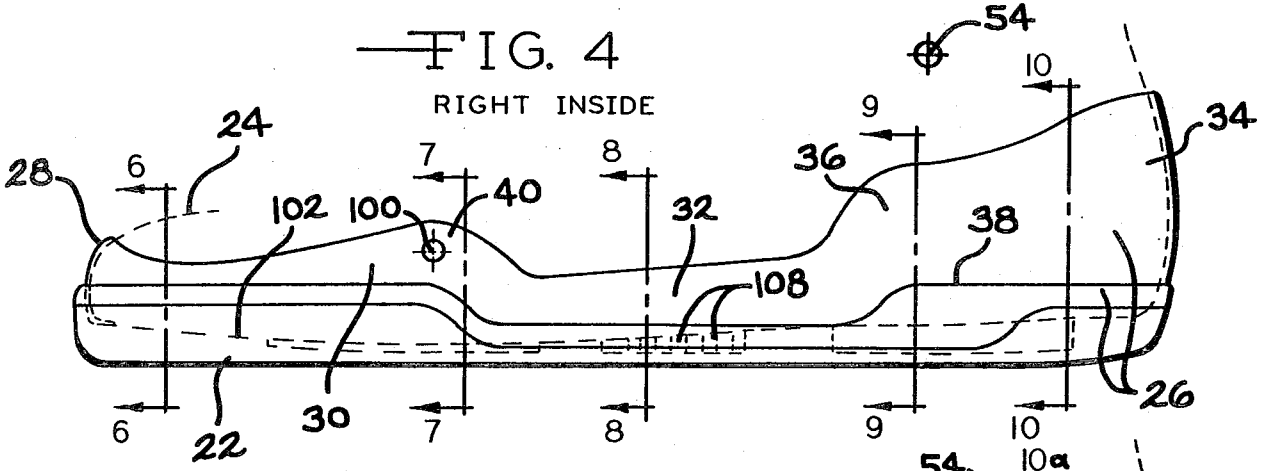
FIGS. 4 and 5 are fragmentary side elevational views of the lateral sides of a shoe according to the invention.
Figure 5:
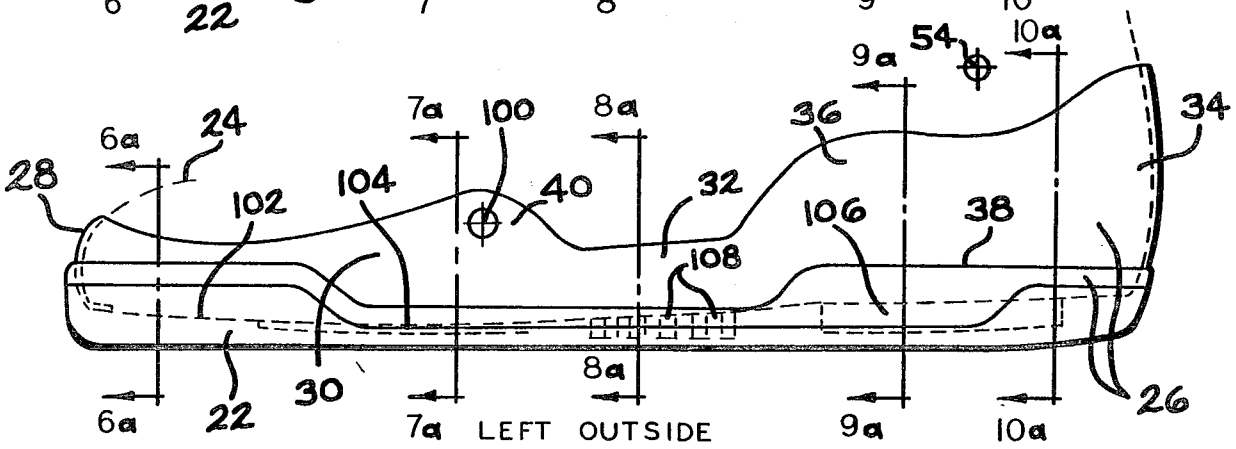

FIGS. 4 and 5 are partial side views of the medial and lateral sides of the outsole 22 and intermediate portions 26 of a shoe according to the invention, and define the locations of sectional views illustrated in FIGS. 6–10 and 6*a*–10*a*. It should be noted that the outsole 22 and intermediate portions 26 of a shoe according to the invention are not symmetrical, and that section planes 7—7 and 7*a*—7*a* pass on alternate sides of the obliquely-oriented axis of metatarsal heads 100 of the foot of the wearer. Sections 6–10, illustrated in greater detail in FIGS. 6–10, are taken at intervals along outsole 22 and intermediate portions 26. Section 6 is a section of the medial side of these portions taken at the heel of the shoe. Sections 6*a*–10*a* are taken in corresponding location at the lateral sides of outsole 22 and intermediate portions 26. The inside surface 102 of portion 26, in a preferred embodiment of the invention, defines a pocket 104 and a pocket 106, for receiving a pair of shock foam inserts, preferably according to U.S. patent application, Ser. Nos. 032,354, 027,313. Shock foam inserts according to these patents act as shock absorbing systems, increasing comfort and reducing foot fatigue leading to injuries, and also acting as springs for recovering some of the energy of the impact of the shoe with a supporting surface. Pockets 104 and 106, and shock foam inserts, are not necessary to practice the invention, but are desirably used in conjunction with the invention. Intermediate portion 26 may also include a plurality of holes or ribs 108 which removing unnecessary material from an area to achieve lightness, in which the removal of material will not compromise lateral and torsional rigidity of the shoe.

Figure 6:
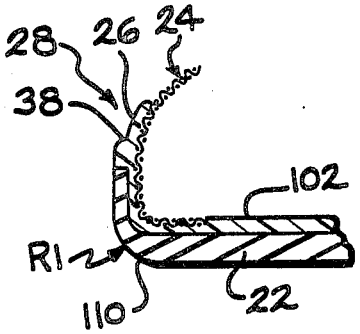
FIGS. 6–10 and **6*a*–10*a* are fragmentary sectional views of the medial and lateral portions of a show according to the invention, taken along lines 6—6 through 10—10 and 6*a*—6*a* through 10*a*—10*a* in FIGS. 4 and 5**.
Figure 6A:
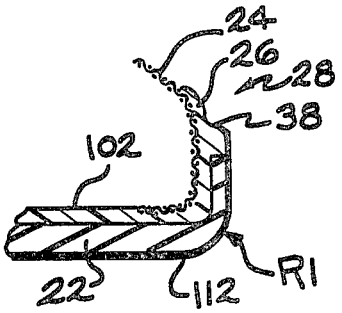
Figure 7:
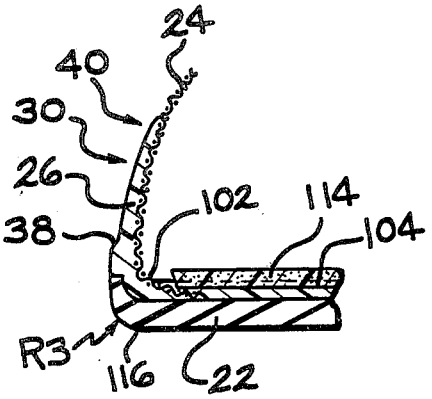
Figure 7A:
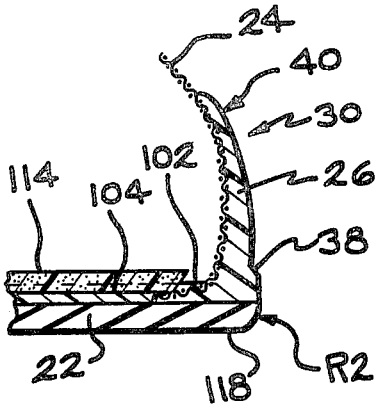
Figure 8:
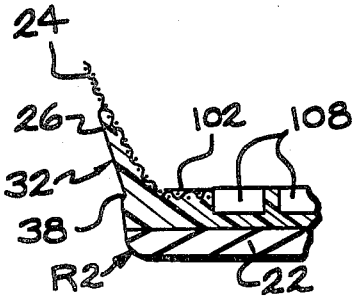
Figure 9:
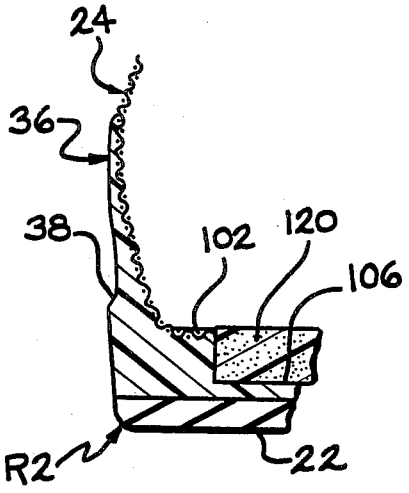
Figure 10:
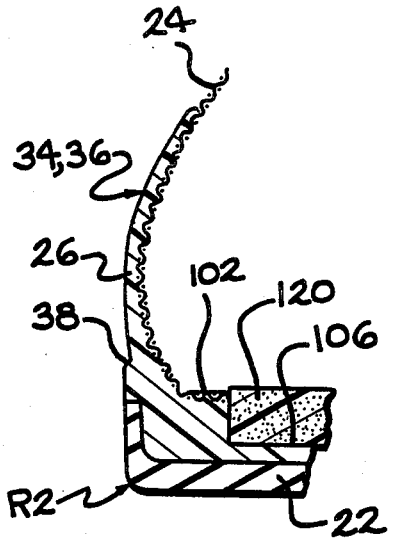
Figure 10A:
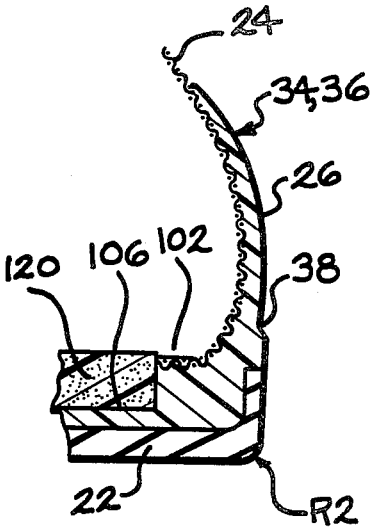

FIGS. 6–10 and 6*a*–10*a* are fragmentary sectional views taken along section planes 6—6 and 10—10 in FIG. 4, and 6*a*—6*a* through 10*a*—10*a* in FIG. 5. The details of the outsole pattern of a shoe according to the invention have been omitted from these figures for clarity. As will be apparent, FIGS. 6 and 6*a* are taken along a plane near the toe of a shoe according to the invention, such as shoe 20 or 72. It should be noted that the radii on opposite corners 110 and 112 may be equal. Also radii may be unequal, being larger on the inside edge. In a shoe according to the preferred embodiment of the invention, each radius R1 is a 0.40 inch (1.02 cm) radius. FIGS. 7 and 7*a* illustrate a section taken in the metatarsal head area of a shoe according to the invention, showing metatarsal portions 30 with highest portions 40 adapted to curve around and support this area of the wearer's foot, reducing the incidence of broken contact between the wearer's foot and inside surface 102 of the shoe and avoiding repeated impact of the wearer's foot upon inside surface 102. Shock foam insert 114 is shown disposed within pocket 104.

It should be specifically noted that in a shoe in accordance with the invention, the radius on corner 116 is substantially different than the radius on corner 118. This has been found to prevent corner 116 from "digging in" or catching, thus restricting the user's ability to move his or her foot quickly in the medial direction with maximum efficiency during the playing movements. In a preferred embodiment of the invention, radius R2, also indicated with respect to FIGS. 8–10 and 8*a*–10*a* is 0.15 inches (0.38 cm) in a preferred embodiment of the invention. A radius R3 for corner 116 of 0.235 inches (0.6 cm) has been found to produce desirable results in conjunction with other features of the preferred embodiment of outsole portion 22.

Figure 8A:
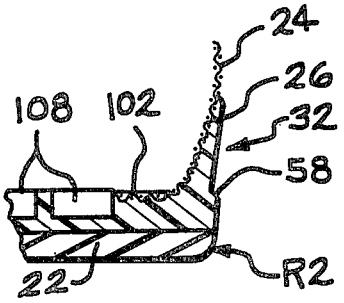

FIGS. 8 and 8*a* illustrate sections through side wall portion 32, showing side wall portion 32 extending upward to provide lateral stability and support to the area of the foot adjacent the metatarsal bones, reducing fatigue of the foot muscles and ligaments in that area. Lightening holes or ribs 108 in inside surface 102 are also illustrated in FIGS. 8 and 8*a*.

Figure 9A:
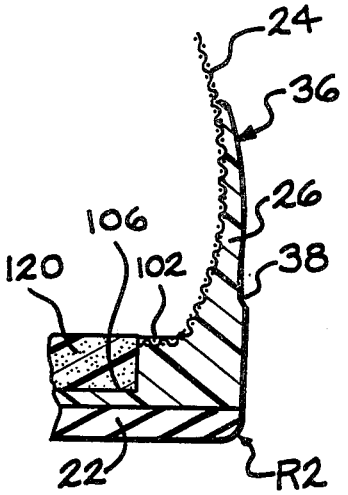

FIGS. 9 and 9*a* illustrate sections of portions 22 and 26 of a shoe according to the invention taken through the side wall portion 36 of heel counter portion 34, showing side wall portions 36 curving inwardly to resiliently conform to the shape of the tarsus bones and hold the heel of the wearer's foot. Shock foam insert 120 is shown disposed in pocket 106.

FIGS. 10 and 10*a* are sectional views of portions 22 and 24 of a shoe according to the preferred embodiment of the invention taken adjacent heel counter portion 36, further illustrating how heel counter portion 36 and side wall portions 34 conform to the heel of a wearer's foot to hold and stabilize the tarsus or rear foot areas, increasing comfort and decreasing fatigue and the result opportunity for injury to the foot and ankle.

Figure 11:
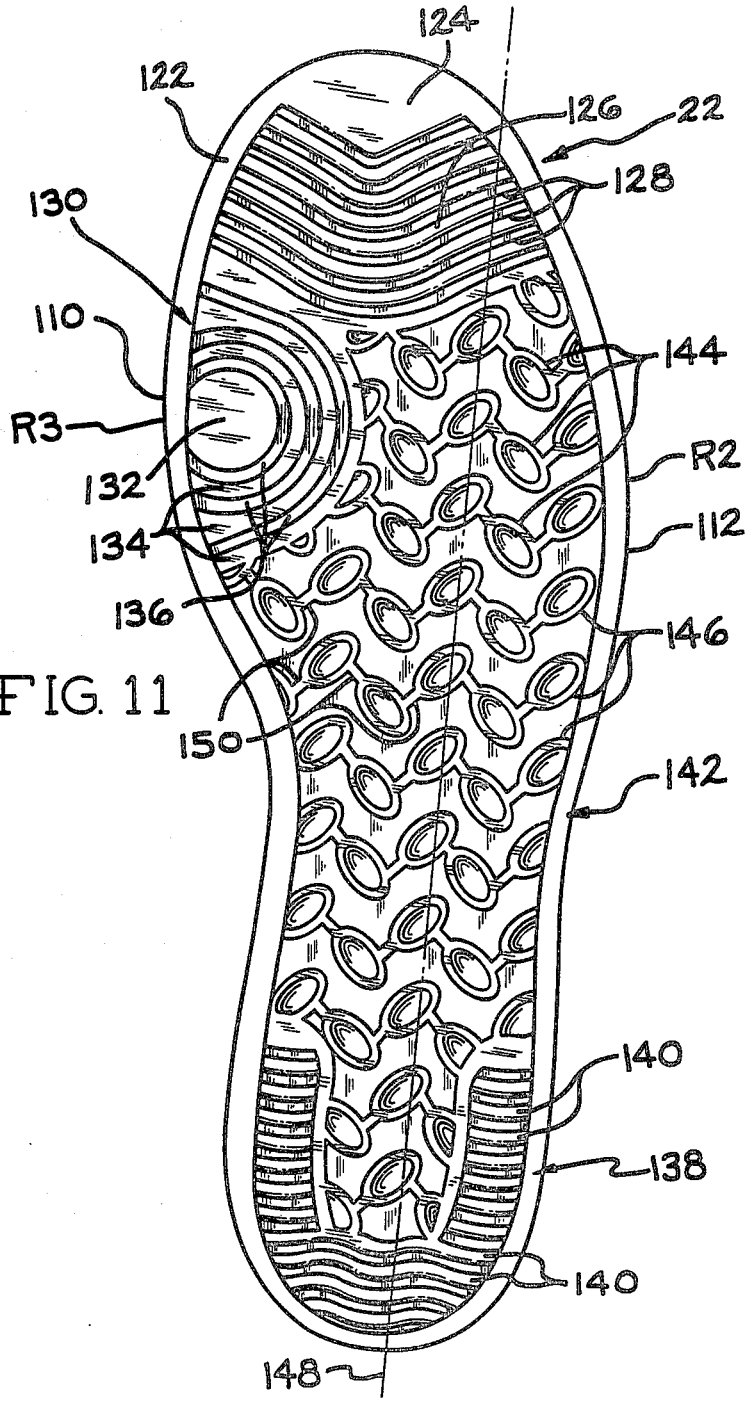
FIG. 11 is a bottom elevational view of a shoe according to the invention, showing the outsole structure of a shoe according to the invention.

FIG. 11 is a plan view of the preferred configuration of a sole for a shoe according to the invention. Outside portion 22 has a sole surface 122, shown as including five distinct areas which together provide improved performance over any known prior art, particularly in providing traction on sweaty or moist playing surfaces. FIG. 11 also shows the location of increased radius R3 and corner 116.

Sole surface 122 includes a tip portion 124, which is a solid block of rubber to provide propulsion and increase the life of the shoe by absorbing the final sliding contact between sole surface 122 and a supporting or playing surface. A toe portion 126 includes plurality of V-shaped ridges 128, having an apex disposed towards the heel of the shoe, and opening toward tip portion 124. Preferrably, ridges 128 are relatively high and of a rounded configuration, to allow wear and traction in this high-wear area and increase the life of the shoe according to the invention. The orientation of ridges 128 produce good traction when starting or stopping.

A target-shaped area 130 disposed adjacent radius R3 and corner 110, being under the ball of the wearer's foot, adjacent the metatarsal heads, allows rapid pivoting about area 130 without slipping, as has been found desirable for court-type games such as basketball. Target-shaped area 130 includes a central raised circular area 132 and a plurality of raised bands 134 generally concentric with central raised area 132 and defining arcuate channels 136 between raised circular area 132 and a band 134, and between raised bands 134. This configuration has been found to facilitate pivoting, but impedes sliding in a direction radial to the center of central raised circular area 132.

A heel area 138 extending around the periphery of the heel portion of sole surface 122 is provided with a plurality of generally W-shaped raised ridges 140. In a preferred embodiment of the invention, ridges 140 are of a rounded shape, and have been found to produce good traction when subjected to the motion of a player's foot during the course of motion typical of a court-type game such as basketball, including running, stopping, and pivoting about the heel, and producing good traction regardless of whether the force applied is an accelerating or decelerating force along the long axis of outsole portion 22.

A central portion 142 of sole surface 122 is provided with a pattern of elliptically-shaped raised ridges and interconnecting ridges which has been found to give unexpectedly good traction when running on a wet or sweaty playing surface. In a preferred embodiment of the invention, elliptically-shaped raised ridges 144 and 146 are disposed in alternately oblique columns along the longitudinal axis 148 of the heel area 136 of outsole portion 22, and extending on either side of longitudinal axis 148 towards toe portion 126, and are interconnected by straight raised ridges 150, forming a generally W-shaped pattern transversed to axis 148. As can be seen by inspection of FIG. 11, this pattern contains elements which are flexible to allow smooth movements between outsole portion 22 and a playing surface, but are reinforced and rigid enough to provide resistance to forces applied in either direction parallel to axis 148, each elliptically-shaped raised ridge having a flexible direction of deflection and a relatively inflexible direction of deflection, alternately disposed so there is no preferred direction of extreme flexible deflection. A more-flexible edge of each elliptically-shaped raised ridge 140 is secured through a straight raised ridge 150 to a relatively inflexible edge of an adjoining elliptically-shaped raised ridge 144.

The overall result of the configuration of sole surface 122 is a sole surface which is well-adapted for the complex motions and forces generated by the foot of a person playing a court-type game, and is optimized to provide a most-suitable surface for each individual area of sole surface 122 involved in particular major motions and forces during the playing of a court-type game such as basketball.

Numerous modifications and variations of the invention, including the characteristics and features of the uppermost portions of the disclosed shoes, and of the lower portions of the disclosed shoes will be obvious to one skilled in the art, and may be made without departing from the spirit and scope of the invention.

We claim:

1. A structure for an athletic shoe, comprising:

a rubber outsole portion;

a fabric upper portion;

a unitary molded resilient intermediate portion;

said intermediate portion being bonded to said rubber outsole portion and to said fabric upper portion and extending continuously around the periphery of said shoe on the outside of said shoe external to said fabric upper portion;

said unitary intermediate portion having a heel counter portion, a sidewall portion, a metatarsal portion and a toe cap portion;

said heel counter portion including side portions extended forwardly towards a toe portion of said shoe and adapted to conform at least in part to the tarsus of a foot of a wearer of said shoe to resiliently restrict lateral movement of said tarsus with respect to said outsole portion;

said sidewall portions extending upwardly from said outsole portion and being adapted to resiliently restrain lateral movement of said tarsus and of the metatarsus of the foot of said wearer;

said metatarsal portion extending upwardly from said outsole portion and adapted at least in part conform to the area adjacent the joints between the metatarsus and phalanges of said foot of said wearer to resiliently restrain said area from lateral movement with respect to said outsole;

said toe cap and said heel counter being adapted to resiliently restrain said foot of said wearer from longitudinal movement with respect to said shoe;

said fabric upper portion including a reinforced lacing portion fastened to said upper portion at an instep area of said shoe and adapted to receive a shoelace;

said upper portion defining an ankle opening, said ankle opening adapted to encircle the ankle of said foot of said wearer approximately adjacent to the subtalar joint of said foot and below the malleoli of a leg of said wearer.

2. A structure for a shoe according to claim 1, wherein:

said intermediate portion is an injection molded intermediate portion, injection bonded to said rubber outsole portion and to said fabric upper portion and defining a unitary assembly of said outsole portion, said intermediate portion and said fabric upper portion.

3. A structure for a shoe according to claim 2, wherein:

said upper portion includes an elastic band fastened to said upper portion about the periphery of of said ankle opening and fastened to said reinforced lacing portion adjacent said ankle opening and adapted to be elastically pulled tight about the ankle of the foot of the wearer by tightening of said shoelace to retain said shoe upon said foot.

4. A structure for a shoe according to claim 3, wherein:

said shoe is further provided with an ankle collar portion joined to said upper portion adjacent said ankle opening and extending above said ankle opening;

said ankle support collar portion including an elastic band adapted to enclose at least in part the ankle of said wearer and the malleoli of the leg of said wearer and adapted to be selectively manually tightened about said ankle and leg, said band being provided with continuously adjustable fastening means.

5. A structure for a shoe according to claim 4, wherein:

said shoe further includes means for resisting inversion of said foot of said wearer disposed on at least the lateral side of said shoe to resist bending of said foot towards a medial side of said leg by resisting stretching of said ankle support collar portion.

6. A structure for a shoe according to claim 4, wherein:

said ankle support collar portion is adapted to extend upwardly from said upper portion and enclose a portion of said leg of said wearer substantially above said malleoli of said leg.

7. A structure for a shoe according to claim 4, wherein:

said continuously-adjustable fastening means is a hook-and-loop fastener.

8. A structure for a shoe according to claim 5, wherein:

said means for resisting inversion of said foot includes a first fabric strip portion fastened to said ankle support portions parallel to an edge of said portion distal to said ankle opening, and a second fabric strip portion generally perpendicularly bisecting said first strip portion and extending from said first strip portion to said fabric upper portion and being joined to said fabric upper portion.

9. A structure for a shoe according to claim 5, wherein:

said means for resisting inversion of said foot includes a plurality of rows of stitching in said ankle support portion.

10. A structure for a shoe according to claim 9, wherein:

said rows of stitching being diverging rows of stitching;

said rows of stitching diverging towards an edge of said portion distal to said ankle opening.

11. A structure for a shoe according to claim 2 wherein;

said rubber outsole portion includes a central portion surface having a plurality of elliptically-shaped raised ridges joined by straight raised ridges;

said elliptically-shaped ridges being alternately obliquely disposed upon said central portion surface and defining a generally W-shaped repeating pattern thereon.

12. A structure for a shoe according to claim 11, wherein:

said rubber outsole portion includes a peripheral portion defining an edge portion having a radius, said edge portion including a lateral edge portion and a medial edge portion;

said medial edge portion including a portion adapted to be disposed adjacent the joint between the metatarsus and phalanges of the foot of the wearer having a greater radius than that of an opposing portion of said lateral edge adapted to be disposed adjacent said joint for allowing said outsole portion to be moved more easily toward said medial side than towards said lateral side upon a supporting surface.

13. A structure for a shoe according to claim 12 wherein:

said rubber outsole portion further includes a toe portion surface and a heel portion surface;

said toe portion surface including a plurality of generally V-shaped raised ridges, said ridges defining a pattern of parallel generally V-shaped ridges having a bight proximal to said heel portion;

said heel portion surface including a plurality of parallel generally W-shaped raised ridges; and said rubber outsole portion defines a raised circular target-shaped portion having a central circular raised portion and at least one concentric raised band portion, said target-shaped portion being disposed adjacent said medial edge of said shoe and adapted to be disposed adjacent the joints between the metatarsus and phalanges of said foot of said wearer, for allowing said shoe to pivot about said target-shaped portion without slipping parallel to said supporting surface.

14. An outsole for a shoe, including:

a surface defining a plurality of spaced protrusions thereon;

said spaced protrusions including a central surface portion defining a plurality of raised elliptically-shaped ridges;

said elliptically-shaped ridges being alternately obliquely disposed upon said surface and defining a generally W-shaped repeating pattern thereon;

said elliptically-shaped ridges being joined by straight raised ridges.

15. An outsole for a shoe according to claim 14, wherein:

said outsole includes a peripheral portion defining an edge portion having a radius, said edge portion including a lateral edge portion and a medial edge portion;

said medial edge portion including a portion adapted to be disposed adjacent the joint between the metatarsus and phalanges of a foot of a wearer of said shoe, having a greater radius than that of an opposing portion of said lateral edge adapted to be disposed adjacent said joint for allowing said outsole to be moved more easily toward said medial side than towards said lateral side upon a supporting surface.

16. An outsole for a shoe according to claim 15, wherein:

said outsole further includes a toe portion surface and a heel portion surface;

said toe portion surface including a plurality of generally V-shaped raised ridges, said ridges defining a pattern of parallel generally V-shaped ridges having a bight proximal to said heel portion;

said heel portion surface including a plurality of parallel generally W-shaped raised ridges; and said outsole defines a raised circular target-shaped portion having a central circular raised portion and at least one concentric raised band portion, said target-shaped portion being disposed adjacent said medial edge portion of said outsole and adapted to be disposed adjacent the joints between the metatarsus and phalanges of said foot of said wearer, for allowing said outsole to pivot about said target-shaped portion without slipping parallel to said supporting surface.

* * * * *